US005699852A

United States Patent [19]

Park et al.

[11] Patent Number: 5,699,852

[45] Date of Patent: Dec. 23, 1997

[54] HEAT EXCHANGER HAVING A RESIN-COATED PIPE

[75] Inventors: Young Jae Park; San Il Park; Kyoung Bin Choi; Young Jin Ha; Ki Ho Park; Chang Bog Ko; Jeong Gun Kim, all of Taejon, Rep. of Korea

[73] Assignee: Korea Institute of Energy Research, Taejon, Rep. of Korea

[21] Appl. No.: 701,659

[22] Filed: Aug. 22, 1996

[51] Int. Cl.[6] ..... F28F 19/02

[52] U.S. Cl. ..... 165/76; 165/82; 165/133; 165/178

[58] Field of Search ..... 165/133, 82, 178, 165/76, 905, 906

[56] References Cited

U.S. PATENT DOCUMENTS

| | | | |
|---|---|---|---|
| 2,368,391 | 1/1945 | Young | 165/178 |
| 4,669,530 | 6/1987 | Warner | 165/1 |

FOREIGN PATENT DOCUMENTS

| | | | |
|---|---|---|---|
| 728656 | 10/1942 | Germany | 165/178 |
| 705240 | 1/1980 | U.S.S.R. | 165/82 |

*Primary Examiner*—Allen J. Flanigan

*Attorney, Agent, or Firm*—Jacobson, Price, Holman & Stern, PLLC

[57] ABSTRACT

A heat exchanger having corrosion resistant resin-coated plates and pipes. The heat exchanger is easily constructed using the corrosion resistant resin-coated plates and the pipes. The heat exchanger does not require heat treatments or large constructing sections. In the heat exchanger according to the present invention, a gas is supplied to the outside of pipes, and air and/or water are passed through the pipes. As a result, heat change is accomplished. A pipe plate and a side wall of the heat exchanger are coated with Teflon or a heat resistant resin. In the feed water pre-heater for heating water, pipes are formed as metal pipes coated with a resin for maintaining the strength of the pipes. Thereafter, the pipes are individually welded and fabricated. In the feed air pre-heater, the heat exchanger has side walls, a pipe plate and pipes. The side walls and the pipe plate have essentially the same structure. The pipes are made of resin. The pipe plate and pipes are united by a metal assembling member. The pipe plate and the metal assembling member are fastened together with a pipe adjacent to them by means of four steel wires in order to prevent the separation of the pipe plate from the assembling member in response to the droop or vibration of the resin pipes.

7 Claims, 2 Drawing Sheets

HEAT EXCHANGER HAVING A RESIN-COATED PIPE

BACKGROUND OF THE INVENTION

1. Field of the Invention

The present invention relates to a heat exchanger having at least one resin-coated plate and a resin-coated pipe for feed air pre-heating and for feed water pre-heating using a corrosive exhaust gas produced from a boiler, an incinerator, a furnace, and the like.

2. Description of the Prior Art

Corrosion resistant devices for collecting corrosive waste heat have been proposed in the past. The proposed devices, however, were lacking in economic gains and durability.

Recently, the technique of manufacturing synthetic resins has become highly developed, and consequently the techniques of manufacturing corrosion resistant and heat resistant synthetic resins has also become well developed. However, the cost of manufacturing the corrosion resistant and heat resistant synthetic resins is high, and it is therefore difficult to use them.

Furthermore, porcelain enamels or ceramic coatings are not highly reliable as the corrosion resistant and heat resistant synthetic resins. In order to manufacture the porcelain enamels or ceramic coatings, it is necessary to perform a pre-treatment such as a sanding operation and a plurality of heat treatments. More particularly, in order to apply the ceramic coatings to the heat exchanger, the heat exchanger must be integrally welded. Thereafter, the ceramic coatings are applied to the heat exchanger. A large heat treatment body is therefore required when heat-treating such a heat exchanger. Further, it is necessary to mechanically treat parts of the heat exchanger which are beyond one's reach.

Therefore, the total process for providing the ceramic coating to the heat exchanger is complicated and the cost of providing the ceramic coatings is therefore excessive.

When the heat exchanger is coated with a resin member such as Teflon, the foregoing problems are also generated.

SUMMARY OF THE INVENTION

The present invention is devised to solve the foregoing problems. Accordingly, it is an object of the present invention to provide a heat exchanger which is easily constructed using corrosion resistant resin-coated plates and pipes. The heat exchanger according to the present invention does not require heat treatments nor does it require large constructing sections.

In the heat exchanger according to the present invention, medium (preferably, a gas) is supplied around the outside of pipes, and another medium (preferably, air and/or water) is passed internally through the pipes. As a result, an exchange of heat is accomplished. A pipe plate and side wall or side plate of the heat exchanger are each coated with a heat resistant resin, such as Teflon or the like. In the feed water pre-heater for heating water, the pipes are formed as metal pipes coated with a resin for maintaining the strength of the pipes. Thereafter, the pipes are individually welded and fabricated. In the feed air pre-heater, the heat exchanger has side walls or side plates, a pipe plate and pipes. The side walls and the pipe plates have generally the same structure as that of the feed water arrangement. The pipes are also made with a resin. The pipe plate and assembling members are united with a metal fastening member. The pipe plate and the assembling members are fastened with a pipe adjacent to them by means of four steel wires in order to prevent the separation of the pipe plate from the assembling members as might otherwise occur in response to the droop or vibration of the resin pipes.

DETAILED DESCRIPTION OF THE PREFERRED EMBODIMENTS

A preferred embodiment of a heat exchanger according to the present invention will be described with reference to the accompanying drawings.

Figure 1:
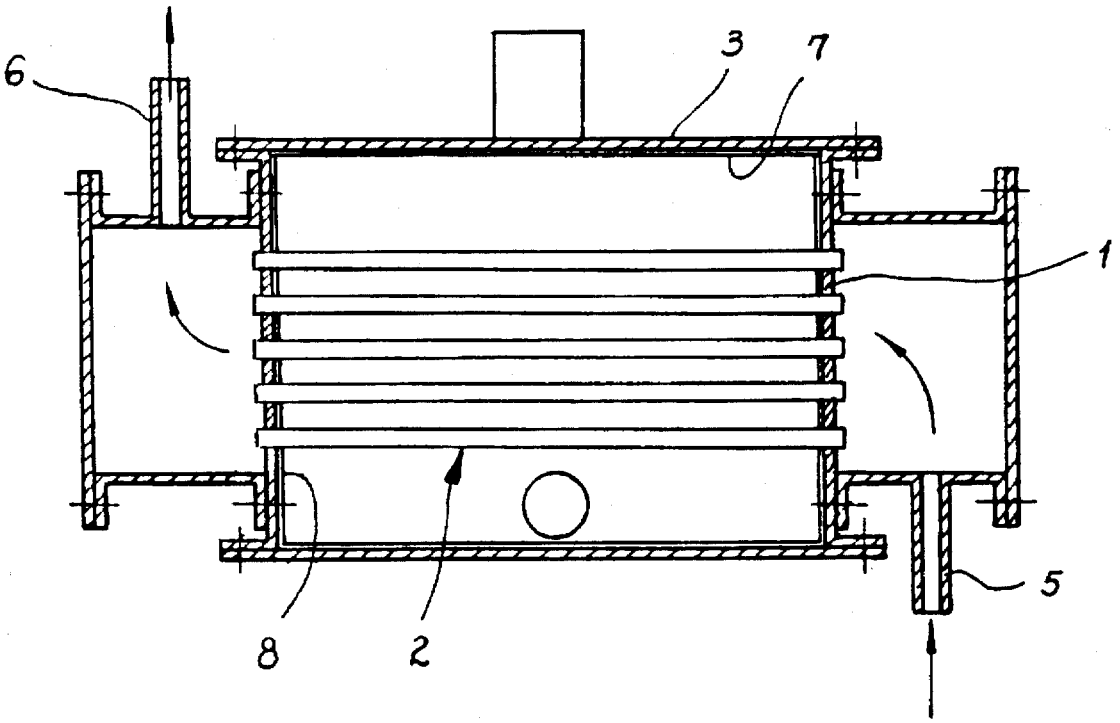
FIG. 1 is a cross-sectional view showing the assembled state of the heat exchanger according to the present invention.

Referring to FIG. 1, the heat exchanger according to the preferred embodiment of the present invention includes pipe plates 1, side plates 3 and a plurality of pipes 9. The pipe plates 1 and the side plates 3 are combined to form a gas-flow passage, and pipes 9 are horizontally installed in the passage defined by the plates 1 and side plates 3. Each pipe plate 1 is coated with a resin plate or a corrosion resistant plate member 8, and the side plates 3 are each coated with a resin plate or a corrosion resistant plate member 7. Resin plates 7 and 8 preferably have a thickness of 0.1 to 1 mm.

Figure 2:
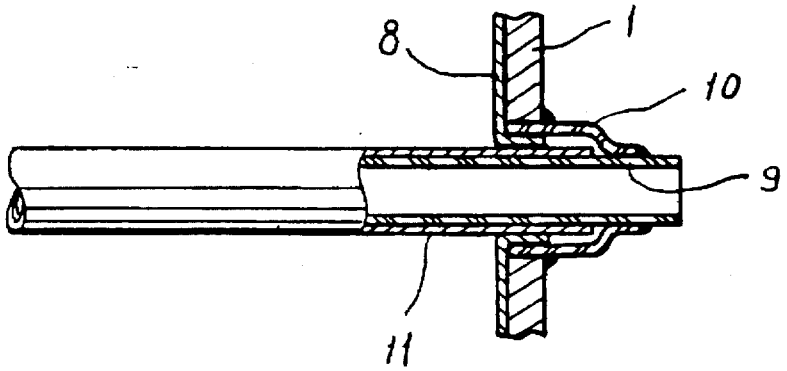
FIG. 2 is an enlarged section view showing a primary portion of the heat exchanger according to the present invention.

FIG. 2 illustrates the assembled state of the feed water pre-heater. At pipe 9, the resin plate 8 which is located on an inside surface of the pipe plate 1 is machined so as to push a portion of the resin plate outwardly. As a result, corrosion of the pipe plate 1 is prevented. In addition, the outer surface of the pipe 9 is renewed within a resin pipe 11, or alternatively, the pipe 9 itself has a coating structure made of a Teflon or ceramic material.

Figure 3:
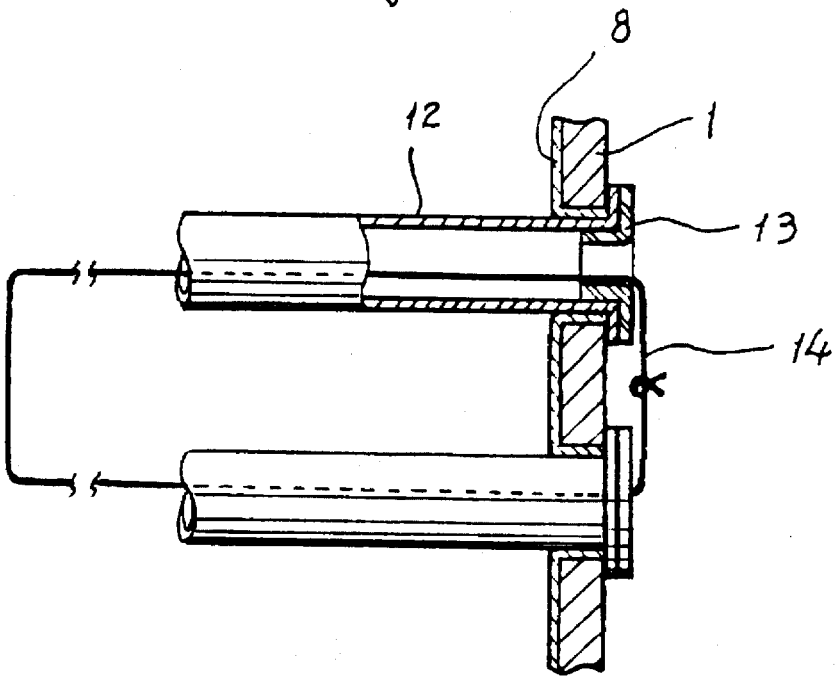
FIG. 3 is an enlarged cross-sectional view showing a primary portion of the air pre-heater according to the present invention.
Figure 4:
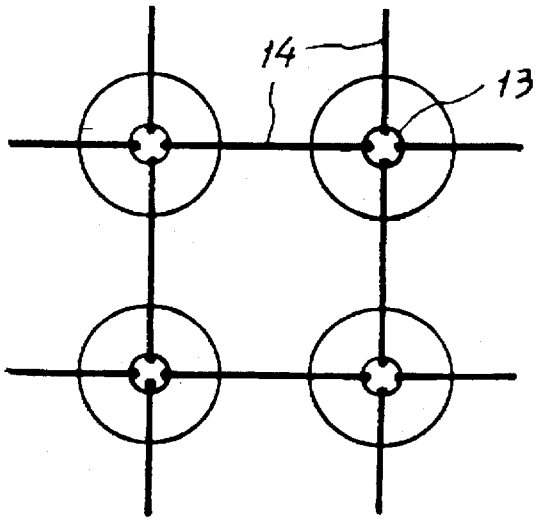
FIG. 4 illustrates an arrangement of wires extending through the pipes according to the present invention.

Meanwhile, a pipe assembling metal pipe 10 is used to connect the pipes to the pipe plate 1, the assembling metal pipe 10 being welded thereto without moving the heat exchanger itself as described above. Shaped portions of resin plate 8 and resin pipe 11 are overlapped and extend outwardly of the gas passage. The gas therefore does not make contact with pipe plate 1, and as a result, the pipe plate 1 can be protected from the gas. Each pipe assembling metal pipe 10 extends slightly beyond the overlapped resin plate 8 and resin pipe 11 to prevent melting or combustion of both resin plate 8 and resin pipe 11 during the welding operation. Therefore, resin plate 8 should be fabricated and machined after welding of the pipe assembling metal pipe 10 to the pipe plate 1 has been accomplished. In the air feed pre-heater's case, the heat exchanger generally has sufficient strength due to the resin pipes. However, if only the resin pipes are installed in the heat exchanger, the heat exchanger may not be able to withstand a bending force produced by the gas or a vibration. Therefore, four steel wires 14 are inserted into resin pipes 9, as shown in FIG. 4. Then, pairs of the steel wires 14 are wound together upwardly and downwardly, as shown in FIG. 3. An assembling member 13 is then inserted into the resin pipe 12. The assembling member 13 is positioned adjacent to an inlet 5. At this time, the steel wire 14 is stretched, and movement of the resin pipe 12 is prevented. As a result, the air feed pre-heater can withstand pressure produced by the gas, and the inlet 5 can be sealed completely.

Figure 5:
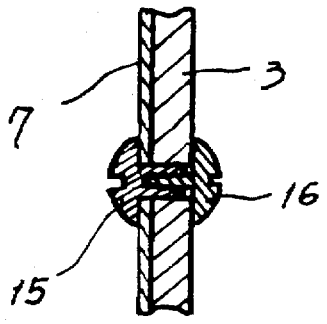
FIG. 5 is a cross-sectional view showing the protective resin plates connected to the side plates according to the present invention.

Referring to FIG. 1, to prevent corrosion of the heat exchanger, the resin plates 7 and 8 are installed doubly, and then side plate 3 and pipe plate 1 are assembled. However, when resin plates 7 and 8 become too large, the steel plate and the resin plate have a tendency to become detached and spaced apart. To solve this problem, a resin fastening member 15 is installed at regular intervals, as illustrated in FIG. 5, and then the resin fastening member 15 is tightened using a bolt 16. The gas introduced into the heat exchanger therefore comes into contact with the resin only. The gas is not brought into contact with the metal plate or the bolt. The resin plates and the steel plates are thus stuck together.

As described above, in the heat exchanger according to the present invention, the portions which contact the corrosive gas are coated with resin. Therefore, corrosion of the portions contacting the corrosive gas is prevented. Preferably, the pipes and pipe plates are coated with a heat resistant material such as Teflon, ceramic, or the like, having a sufficient heat resistance. Each pipe is capable of being processed automatically and the pipe plates are capable of being coated and welded using the fastening member without any disturbance. Therefore, pipe plates are capable of being constructed while maintaining sufficient spacing. The manufacturing cost of the heat exchanger is therefore decreased.

While the present invention has been particularly shown and described with reference to a particular embodiment thereof, it will be understood by those skilled in the art that various changes in form and detail may be effected therein without departing from the spirit and scope of the invention, which is defined by the appended claims.

We claim:

1. A heat exchanger comprising:

a plurality of pipe plates coated with a resin;

a plurality of side plates coated with the resin and interconnected with said pipe plates to define a flow passage surrounded by resin; and a plurality of pipes having an outer surface thereof coated with the resin, said plurality of pipes being connected to said plurality of pipe plates so that a first medium is able to flow through an interior of said pipes, said plurality of pipes being arranged so as to traverse said flow passage to facilitate heat exchange between said first medium and a second medium flowing through said flow passage, wherein said resin which coats said pipes terminates outside of the flow passage before the distal ends of the pipes, thereby leaving outside surfaces of the pipes exposed outside of the flow passage, and further comprising at least one pipe assembling element connected to one of said pipe plates so as to project outwardly from said pipe plate and out of contact with said second medium, said pipe assembling element being arranged so as to contact one of said distal ends of the pipes and permit welding of said pipe assembling element to said distal end to thereby secure the distal end to the pipe plate without damaging said resin.

2. The heat exchanger as claimed in claim 1, wherein said pipe plates, said side plates, and said pipes are fastened together by means of a plurality of wires installed within said pipes.

3. The heat exchanger as claimed in claim 2, wherein said pipe plates are fastened using assembling members in order to prevent said pipe plates and said side plates from separating and wherein said pipe plates and said side plates remain out of contact with said second medium.

4. The heat exchanger as claimed in claim 1, wherein said resin which coats said pipe plates extends outwardly of the flow passage via openings in said pipe plates, said pipes being arranged so as to extend out of said flow passage through said openings, so that the resin which coats said pipe plates and extends outwardly of the flow passage bears directly against the resin which coats said pipes.

5. The heat exchanger as claimed in claim 1, wherein said pipe assembling element comprises at least one pipe assembling metal pipe located circumferentially around said distal end of the pipes for interconnecting said distal end to said pipe plate.

6. A heat exchanger comprising:

a plurality of pipe plates coated with a resin;

a plurality of side plates coated with the resin and interconnected with said pipe plates to define a flow passage surrounded by resin; and a plurality of pipes having an outer surface thereof coated with the resin, said plurality of pipes being connected to said plurality of pipe plates so that a first medium is able to flow through an interior of said pipes, said plurality of pipes being arranged so as to traverse said flow passage to facilitate heat exchange between said first medium and a second medium flowing through said flow passage, wherein said pipe plates, said side plates, and said pipes are fastened together by means of a plurality of wires installed within said pipes.

7. The heat exchanger as claimed in claim 6, wherein said pipe plates are fastened using assembling members in order to prevent said pipe plates and said side plates from separating and wherein said pipe plates and said side plates remain out of contact with said second medium.

* * * * *